US006969415B2

(12) United States Patent
Traut et al.

(10) Patent No.: US 6,969,415 B2
(45) Date of Patent: Nov. 29, 2005

(54) VENT FOR AND METHOD OF CONCEALING AND VENTING A SEPTIC SYSTEM

(75) Inventors: William M. Traut, Sharon, MA (US); Stanley J. Sreda, Sharon, MA (US)

(73) Assignee: BS Design Corp., Sharon, MA (US)

( * ) Notice: Subject to any disclaimer, the term of this patent is extended or adjusted under 35 U.S.C. 154(b) by 48 days.

(21) Appl. No.: 10/073,184

(22) Filed: Feb. 13, 2002

(65) Prior Publication Data

US 2003/0150197 A1 Aug. 14, 2003

(51) Int. Cl.[7] ..... B01D 39/02; B01D 53/04; E03F 11/00

(52) U.S. Cl. ..... 55/385.4; 55/385.1; 55/320; 55/505; 55/510; 220/371; 220/374; 74/606 R; 47/29.5; 47/31.1; 47/54; 52/90.1

(58) Field of Search ..... 55/385.1, 385.4, 55/320, 505, 510; 220/371, 374; 74/606 R; 47/29.5, 31.1, 54; 52/90.1

(56) References Cited

U.S. PATENT DOCUMENTS

| | | | | | |
|---|---|---|---|---|---|
| D171,020 | S | | 12/1953 | Anderson | |
| 4,439,323 | A | | 3/1984 | Ball | |
| 4,596,491 | A | * | 6/1986 | Dietzler | 405/139 |
| 4,649,677 | A | * | 3/1987 | Oldham | 52/90.1 |
| 4,650,367 | A | * | 3/1987 | Dietzler | 405/154 |
| 5,413,706 | A | | 5/1995 | Graves | |
| 5,723,271 | A | * | 3/1998 | Bjorn | 55/355.4 |
| 6,015,444 | A | * | 1/2000 | Craft et al. | |
| 6,022,389 | A | * | 2/2000 | Vross et al. | |
| 6,237,279 | B1 | | 5/2001 | Smith | |
| 6,248,411 | B1 | | 6/2001 | Warfel | |
| D492,752 | S | * | 7/2004 | Traut et al. | D23/206 |
| D493,511 | S | * | 7/2004 | Traut et al. | D23/260 |
| D494,662 | S | * | 8/2004 | Traut et al. | D23/260 |

FOREIGN PATENT DOCUMENTS

| | | |
|---|---|---|
| DE | 2617364 | 11/1977 |
| DE | 3537367 | 4/1987 |
| FR | 2769850 | 4/1999 |

OTHER PUBLICATIONS

Airex Corporation, Specialty Filters, undated, 1 page.
Orenco Systems, 3" and 4" Carbon Filters, Feb. 2001, 2 pages.

* cited by examiner

*Primary Examiner*—Duane Smith
*Assistant Examiner*—Minh-Chau T. Pham
(74) *Attorney, Agent, or Firm*—William A. Bonk, III

(57) ABSTRACT

Disclosed are a vent disclosed for a septic system, including a conduit configured to vent gas therefrom, including a leg configured to conceal a portion of, and convey gas from, the conduit, and a method of concealing a conduit configured to vent gas from a septic system including sizing the conduit, then mounting on the conduit a leg configured to convey gas from the conduit.

19 Claims, 6 Drawing Sheets

FIG. 1 - PRIOR ART

VENT FOR AND METHOD OF CONCEALING AND VENTING A SEPTIC SYSTEM

BACKGROUND OF THE INVENTION

As people move farther from cities, which generally provide centralized waste treatment facilities, these suburban and rural homeowners often must improve their lots to treat waste products. Such improvements typically include installing septic systems. Septic systems assume many forms and sometimes have associated leach fields for returning treated waste to the environment in a controlled manner. For brevity, as used herein, "septic system" refers to any type of installation that treats waste, including associated leach fields or related systems.

State regulations typically dictate the type of and installation requirements for septic systems. State regulations generally are driven solely by functional considerations and afford minimal leeway to avoid undesirable aesthetic consequences of installing septic systems according to the regulations. Thus, unfortunately, rural homeowners required to have a septic system often are left with a prominently visible telltales of septic system installations that destroy the natural beauty of the land which the homeowner sought to enjoy.

For example, referring to FIG. 1, many state septic system regulatory schemes require venting of septic systems with a vent V. Vent V has an upstanding outlet pipe P and a down turned end D, which define a candy cane shape. While pipe P provides for releasing gases generated by waste decomposition processes in the underlying septic system, down turned end D prevents introduction of debris and precipitation into the septic system which might adversely impact the treatment capability thereof. Because state regulations often prescribe placement of septic systems, leach fields and venting therefor, quite often the homeowner is left to deal with a giant, unsightly candy cane shaped vent V in the middle of the homeowner's lawn or garden.

Some homeowners, dissatisfied with the unsightly appearance of vent V in their yard, modify vent V. For example, some homeowners cut vent V short to render it less obvious. However, such modification may reduce or eliminate the effectiveness of vent V, having been rendered more susceptible to entry by insects, small animals, debris and precipitation. Such modification also may eliminate or defeat filtration devices installed in or configured as part of vent V prior to modification.

Other homeowners attempt to disguise vent V with covering devices such shown in U.S. Pat. No. 6,248,411, issued Jun. 19, 2001, to R. C. Warfel and U.S. Pat. No. 6,237,279, issued May 29, 2001, to J. H. Smith. However, such covering devices also may reduce or eliminate effectiveness of vent V, as such may significantly reduce or preclude flow through vent V. Further, such devices often are perceived as obvious contrivances to hide something in the yard.

Yet other homeowners attempt to hide the unsightly candy cane shaped vent V by growing shrubbery therearound. However, due to the substantial size of vent V, absent a very mature, well-foliaged hedge or bank or shrubs, vent V is never completely secluded from view.

What are needed, and not taught or suggested in the art, are a vent for and method of concealing and venting a septic system.

SUMMARY OF THE INVENTION

The invention overcomes the disadvantages noted above by providing a vent for and method of concealing and venting a septic system.

According to the invention, a vent for a septic system, including a conduit configured to vent gas therefrom, includes a leg configured to conceal a portion of, and convey gas from, the conduit. A method of concealing a conduit configured to convey gas from a septic system according to the invention includes sizing the conduit, then mounting on the conduit a leg configured to convey gas from the conduit.

The invention provides for concealing and venting a septic system.

The invention provides for venting a septic system in a manner that complies with state regulatory schemes.

The invention provides for easy installation of a vent that conceals and vents a septic system.

The invention provides a vent and a method for venting a septic system that releases decomposing gas to the atmosphere and discourages debris from entering the septic system.

The invention provides improved elements and arrangements thereof, for the purposes described, which are inexpensive, dependable and effective in accomplishing intended purposes of the invention. Other features and advantages of the present invention will become apparent from the following description of the preferred embodiments which refers to the accompanying drawings.

BRIEF DESCRIPTION OF THE DRAWINGS

The invention is described in detail below with reference to the following figures, throughout which similar reference characters denote corresponding features consistently, wherein.

DETAILED DESCRIPTION OF THE PREFERRED EMBODIMENTS

Figure 2:
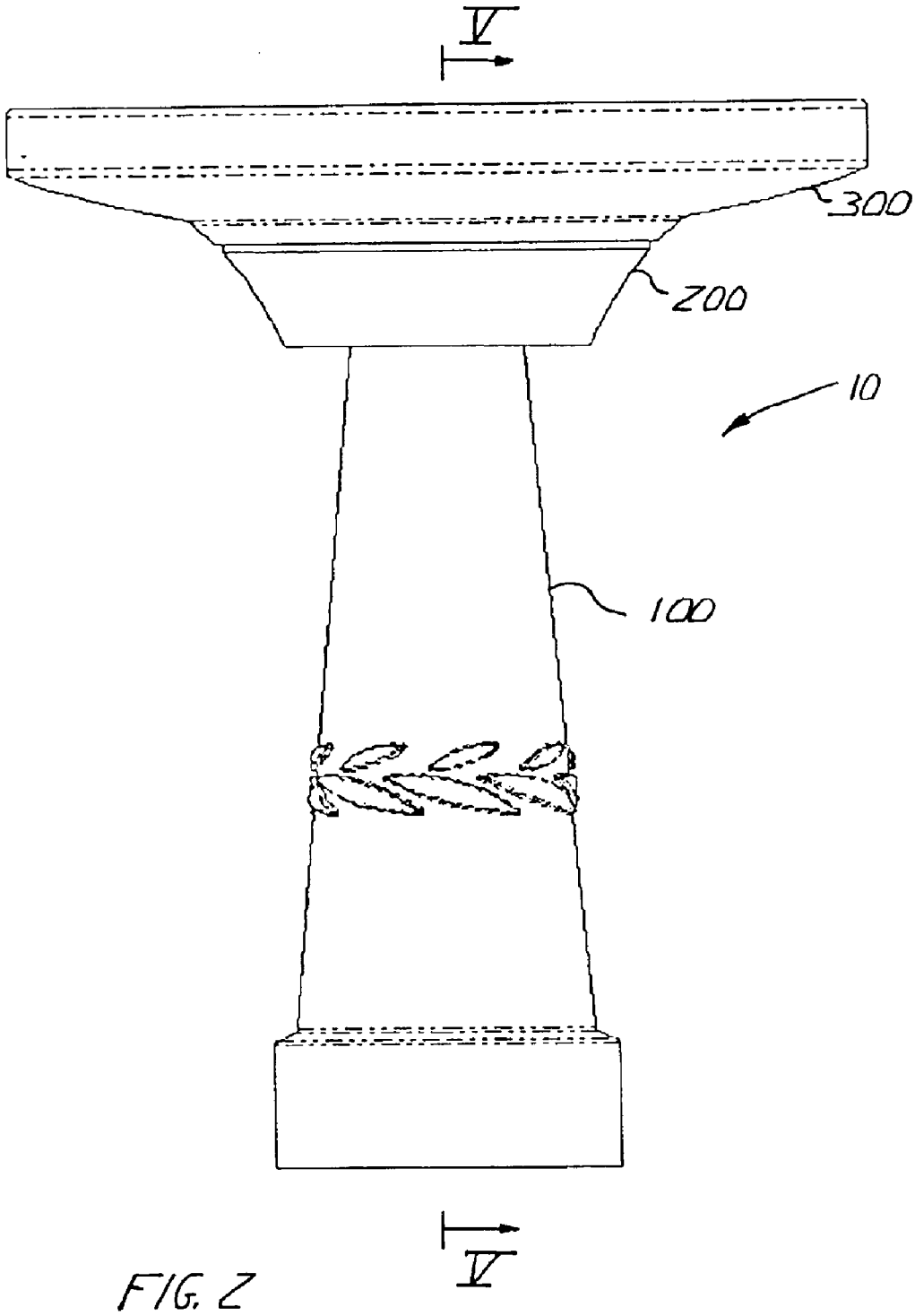
FIG. 2 is a front elevational view of an embodiment of a vent according to principles of the invention.
Figure 3:
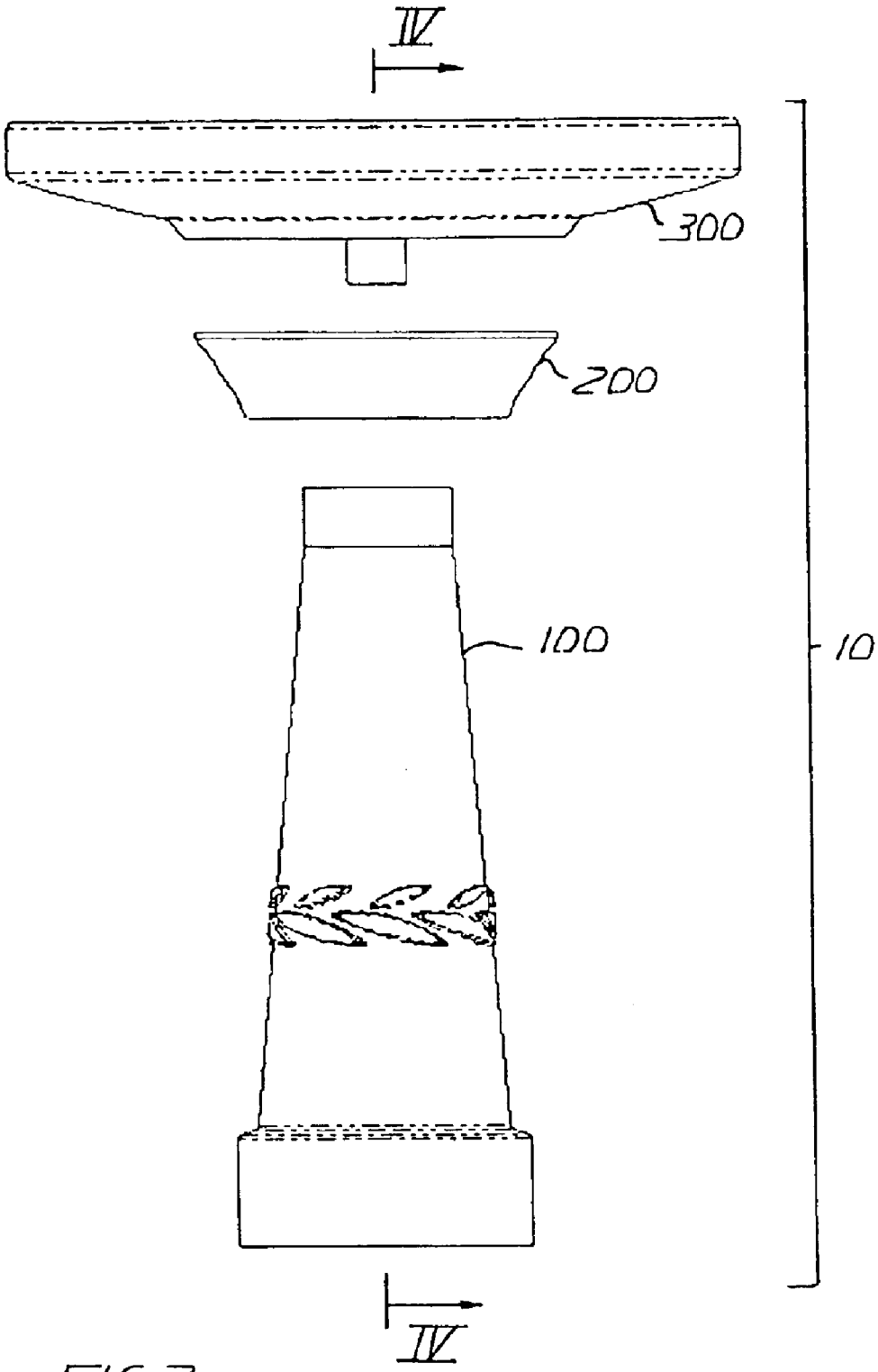
FIG. 3 is an exploded elevational view of the embodiment of FIG. 2.

Referring to FIGS. 2 and 3, a vent 10 according to the invention includes a leg 100, an optional fixture mount 200 and a fixture 300. Leg 100 and fixture mount 200 effect venting of a septic system (not shown), whereas fixture 300 more completely effects concealing a septic system vent pipe P, as described below.

Figure 4:
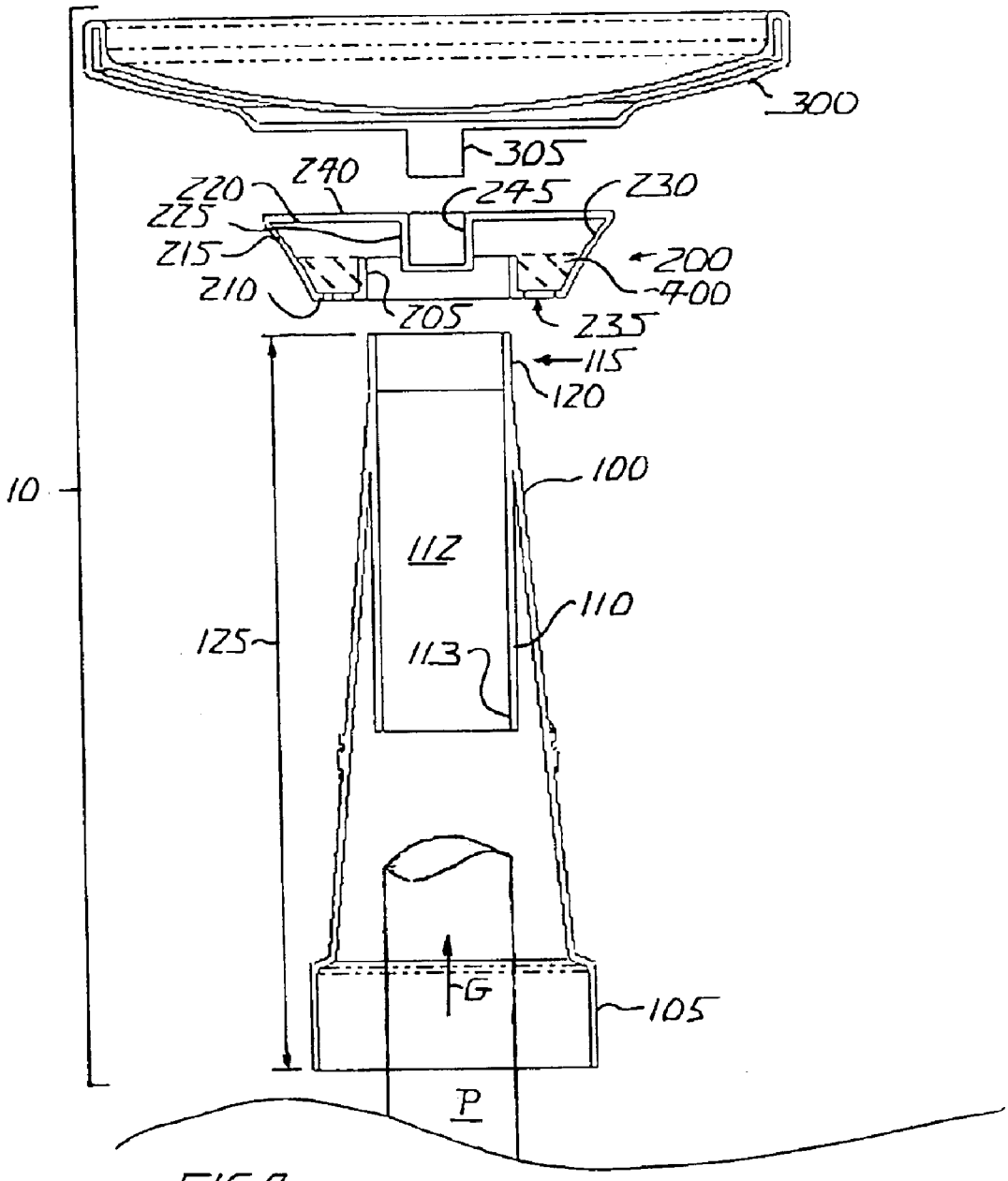
FIG. 4 is a cross-sectional detail view, drawn along line IV—IV in FIG. 3.
Figure 5:
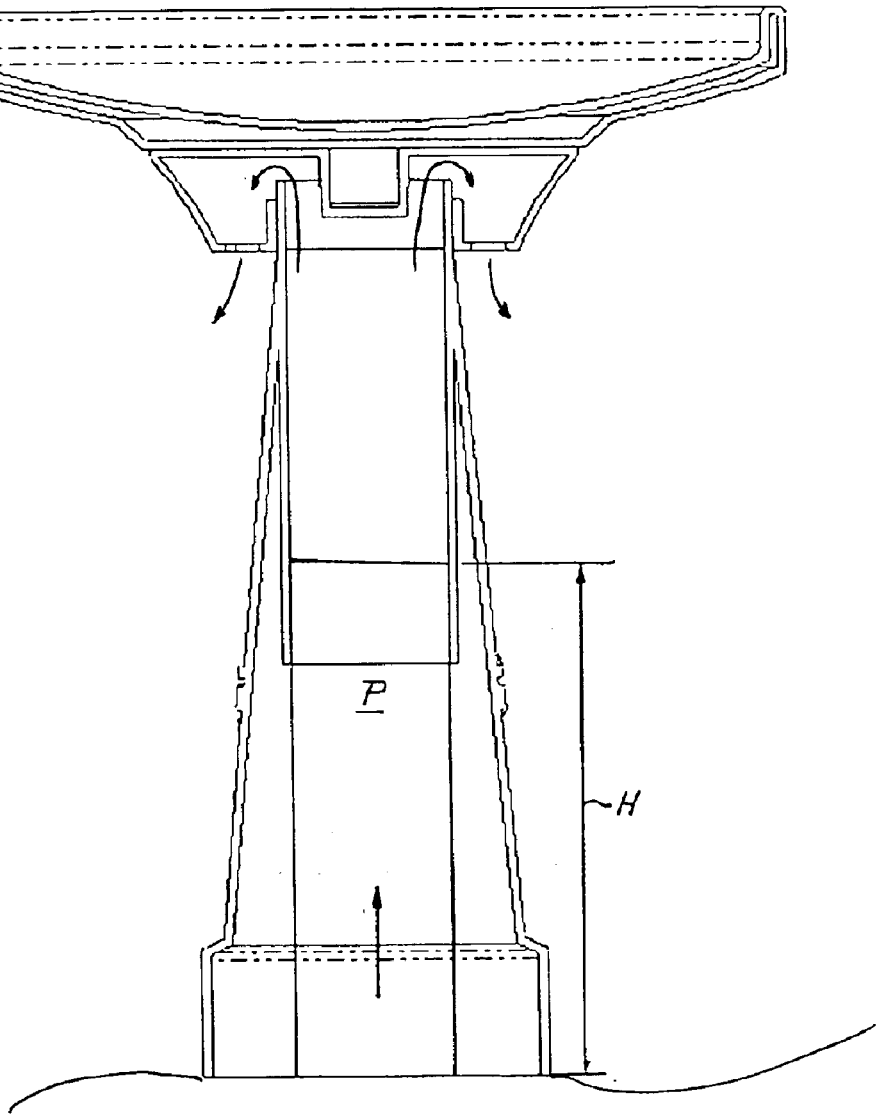
FIG. 5 is a cross-sectional detail view, drawn along line V—V in FIG. 2.

Referring to FIGS. 4 and 5, leg 100 has a base 105 that may be open or otherwise adapted to receive a portion of a septic system vent pipe P. Leg 100 supports fixture mount 200 and fixture 300. As shown in FIG. 2, leg 100 may define any shape or be disposed with any surface characteristics which a user may find aesthetically pleasing. Preferably, leg 100, fixture mount 200 and fixture 300 project a high-quality appearance commensurate with being a strategically placed lawn or garden ornament, rather than an obvious attempt to hide an ugly septic system vent pipe.

Leg 100 has a sleeve 110 that defines a passage 112 with an interior annular surface 113. Sleeve 110 conveys gas G received from vent pipe P. Preferably, sleeve 110 passes gas to fixture mount 200.

Annular surface 113 is adapted to closely receive vent pipe P. Surface 113 may be local to where pipe P is received in passage 112. The snug fit between sleeve 110 and vent pipe P aids in anchoring vent 10 against unsettling forces, such as wind, precipitation, small animate and inanimate bodies disposed on fixture or minor collisions therewith. However, sleeve 110 should not be so tightly secured to vent pipe P that force applied to vent 10 transfers to vent pipe P in an amount that damages the underlying septic system (not shown).

An alternative embodiment of the invention includes a coupling, such as a bellows (not shown), for adapting sleeve 110 to maintain fluid communication with a vent pipe outlet having a size or orientation that deters reception in sleeve 110. For example, if the vent pipe outlet has a larger or smaller size, which would not mate properly for effective fluid communication with vent pipe P, the coupling would be configured with an inlet complementary of the mis-sized vent pipe outlet. If vent pipe P is misaligned, or otherwise situated so as to deter coaxial receipt in sleeve 110, the coupling would provide flexibility to bend or jog sufficiently to mate with vent pipe outlet. The coupling also may remedy leaks that otherwise might exist due to poor sealing conditions between annular surface 113 and a jagged or warped mating vent pipe surface.

Leg 100 has a vertical dimension 125 that is variable as needed to comply with state regulation or design criteria regarding height requirements for septic system venting. Because vertical dimension 125 is inherent to leg 100, a homeowner is not required to perform measurements or even comprehend existence of a minimum height requirement. Consequently, a homeowner may install vent 10 on vent pipe P, as described below, without any potential for running afoul of government requirements or causing inadequate venting of a septic system.

Leg 100 has a top 115 configured to mount with fixture mount 200. To that end, top 115 may define an annular surface 120 configured to mate with, or be closely received by, a complementary annular surface 205 of fixture mount 200. Other mounting conventions also may be employed.

Figure 6:
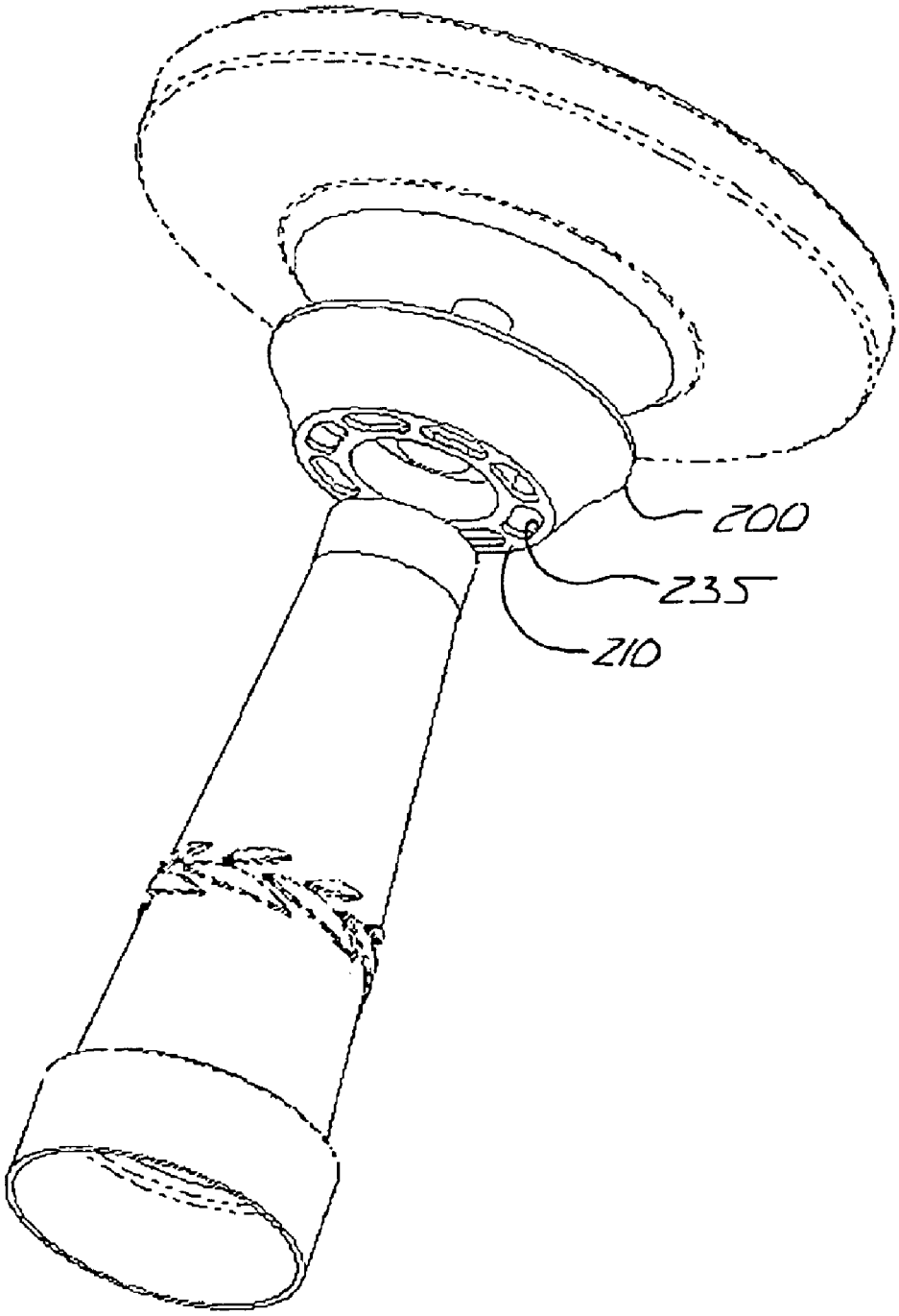
FIG. 6 is an exploded, bottom front perspective view of the embodiment of FIG. 3.

Fixture mount 200 has a lower wall 210, a side wall 215, a top wall 220 and an inner wall 225 that define a passage 230. Passage 230 conveys gas G received from sleeve 110 to the atmosphere. The particular configuration of passage 230 shown is not required, rather may assume any configuration sufficient for conveying gas G from sleeve 110. As best seen in FIG. 6, apertures 235 in lower wall 210 through which gas G ultimately passes into the atmosphere open downwardly to discourage precipitation and debris from entering the septic system which vent 10 may service.

Fixture mount 200 is optional because fixture mount 200 is not required for leg to effect venting or concealing of pipe P. Although not shown, fixture 300 may be configured to mount directly on leg 100 and provide ventilation with down turned outlets in a manner consistent with fixture mount 200. However, because of a generic mounting surface 240 provided by fixture mount 200, as described below, employing leg 100 and fixture mount 200 provides for greater options with respect to fixtures 300, which otherwise may not mount directly on leg 100, which may be disposed on surface 240 for long-term enjoyment.

Top wall 220 defines mounting surface 240 for supporting fixture 300. An optional recess 245 in mounting surface 240 accommodates an optional complementary projection 305 extending from fixture 300 for securing fixture 300 relative to fixture mount 200. Other mounting conventions for securing fixture 300 relative to fixture mount 200 may be used. However, no mounting convention is required to achieve the invention.

An alternative embodiment of the invention includes a filter or filter cartridge 400 for filtering gas received from vent pipe P prior to release into the atmosphere. Preferably, filter 400 is disposed in fixture mount 200. Filter 400 may be constructed of charcoal or other materials for removing or treating harmful or undesirable gas components.

Fixture 300 ornaments leg 100 and fixture mount 200, and may assume any aesthetically pleasing configuration. As shown in FIG. 2, fixture 300 defines a birdbath basin. Fixture 300 also may define, but is not limited to defining, what are commonly referred to as a gazing ball, a statue, a sun dial or other garden ornament (not shown).

Figure 1:
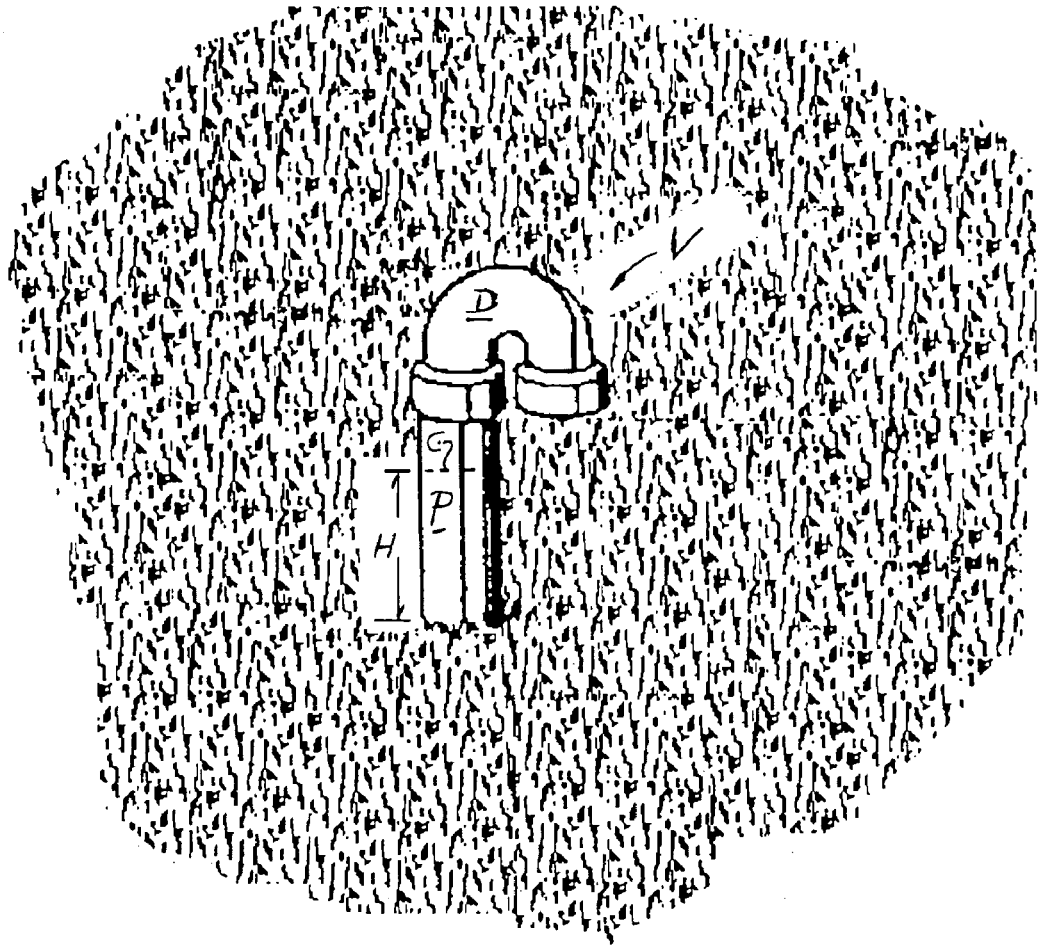
FIG. 1 is an environmental perspective view of a conventional septic system vent.

Referring again to FIG. 1, the method of concealing and venting a septic system includes sizing the conduit or pipe P which conveys gasses from a septic system. Sizing includes cutting pipe P along a cut line C located at a predetermined height H from the ground, or other measurement which may be dictated by regulatory or other design constraints. Preferably, cut line C should be square to the length of pipe P and present a generally continuous outer annular surface for providing a good seal with inner annular surface 113 of sleeve 110 or coupling (not shown) interposed therebetween.

Referring again to FIGS. 4 and 5, once pipe P is sized, the method includes mounting on pipe P a leg configured to convey gas from the conduit. For example, leg 100 has sleeve 110 which, when mounted on pipe P as shown in FIG. 5, receives gas G from pipe P. Mounting includes effecting an appropriate connection between the leg and pipe P. Thus, the local area of pipe P where cut line C will occur should be selected carefully to ensure optimal sealing and mounting conditions with respect to pipe P. Effecting an appropriate connection may include press fitting sleeve 110 onto pipe P. However, such press fit should not be so tight as to prevent leg 100 from resting on the ground or surrounding mounting surface, which would cause pipe P to bear the weight of vent 10, which may include an especially heavy fixture 300, and damage connections between pipe P and the underlying septic system if not the septic system itself.

Although not required for concealing or venting, preferably, the method includes mounting a fixture 300 on leg 100. Displaying fixture 300 may present a more complete display, thereby more effectively concealing vent pipe P.

Although fixture mount 200 is shown interposed between leg 100 and fixture 300, such is not required for mounting fixture 300 on leg 100, as explained above. With or without an interposed fixture mount 200, once fixture 300 is installed on leg 100, the resultant vent 10 effectively conceals and vent pipe P.

Preferably, the method includes interposing fixture mount 200 between leg 100 and fixture 300. As described above, fixture mount 200 provides a generic mounting surface 240 for displaying a large range of viewable objects.

Another embodiment of the method includes disposing a filter 400 in passage 230 of fixture mount 200, as described above.

The invention is not limited to the particular embodiments described herein, rather only to the appended claims.

We claim:

1. Vent for a septic system, including a conduit extending and configured to convey gas therefrom, comprising a leg configured to mount on, conceal a portion of and convey gas from the conduit;

wherein said leg is configured for mounting one of a plurality of fixtures thereon.

2. Vent of claim 1, wherein said leg closely or sealingly receives the conduit.

3. Vent of claim 1, wherein said leg defines a passage configured to receive the conduit.

4. Vent of claim 3, further comprising a coupling for conveying gas from the conduit to said passage.

5. Vent of claim 4, wherein the conduit has an outlet that defines a first size and said passage has an inlet that defines a second size that is different from the first size.

6. Vent of claim 4, wherein the conduit is misaligned relative to said passage.

7. Vent of claim 1, further comprising a filter for filtering gas conveyed through said passage.

8. Vent of claim 1, further comprising a fixture mounted on the leg.

9. Vent of claim 8, wherein said fixture is selected from a bird bath basin, a gazing ball, a statue, a sun dial, a garden ornament and combinations thereof.

10. Vent of claim 8, further comprising a fixture mount interposed between said leg and said fixture.

11. Vent of claim 10, wherein said fixture mount defines a passage for conveying gas from said leg to the atmosphere.

12. Vent of claim 11, further comprising a filter for filtering gas conveyed through said passage.

13. Method of concealing a conduit extending and configured to convey gas from a septic system comprising:

sizing the conduit; then mounting on the conduit a leg configured to convey gas from the conduit;

wherein the leg is configured for mounting one of a plurality of fixtures thereon.

14. Method of claim 13, wherein the leg defines a passage for conveying gas from the conduit, said method further comprising, between said sizing and said mounting, interposing a coupling between the conduit and the passage.

15. Method of claim 13, wherein the leg defines a passage for conveying gas from the conduit, said method further comprising disposing a filter in the passage.

16. Method of claim 13, further comprising mounting a fixture on the leg.

17. Method of claim 16, wherein the fixture is selected from a bird bath basin, a gazing ball, a statue, a sun dial, a garden ornament and combinations thereof.

18. Method of claim 17, further comprising interposing a fixture mount between the leg and the fixture.

19. Method of claim 18, wherein the fixture mount defines a passage for conveying gas from the leg to the atmosphere, said method further comprising disposing a filter in the passage.

* * * * *